United States Patent [19]

Uhtenwoldt

[11] 4,363,196

[45] Dec. 14, 1982

[54] GAGE CONTROLLED GRINDING METHOD

[75] Inventor: Herbert R. Uhtenwoldt, West Boylston, Mass.

[73] Assignee: Cincinnati Milacron-Heald Corp., Worcester, Mass.

[21] Appl. No.: 216,783

[22] Filed: Dec. 15, 1980

[51] Int. Cl.[3] ..... B24B 1/00; B24B 49/04

[52] U.S. Cl. ..... 51/291; 51/165.74; 51/165.71

[58] Field of Search ..... 51/281 R, 165 R, 165.71, 51/165.74, 290, 291

[56] References Cited

U.S. PATENT DOCUMENTS

| | | | |
|---|---|---|---|
| 2,937,478 | 5/1960 | Maker | 51/165.71 |
| 3,475,826 | 11/1969 | Hart et al. | 51/165.74 |
| 3,855,735 | 12/1974 | Tateisi et al. | 51/165 R |
| 3,862,517 | 1/1975 | Porter, Jr. | 51/281 R |

*Primary Examiner*—Stephen G. Kunin
*Assistant Examiner*—Robert A. Rose
*Attorney, Agent, or Firm*—Thomas M. Farrell

[57] ABSTRACT

A gage controlled grinding method for oppositely disposed commonly tapered end bores in a workpiece, maintaining a constant spacing of two identical bore gage diameters independent of part length is disclosed. A machine such as an internal grinding machine utilizes a drive plate and support shoes for locating and driving the workpiece, and a pair of gage fingers are provided at axial points proximal and distal to the drive plate. A first tapered bore in the outboard end of the workpiece is ground and gaged to a predetermined diameter at a first fixed gage distance from the curve plate. The workpiece is turned end-for-end on the drive plate, and the previously finished bore is sampled by a second gage finger located at a second fixed gage distance from the drive plate. The sampled diameter is compared with a predetermined stored value, and the sampled diameter is subtracted from the predetermined stored value to generate a difference value. The difference value is added to the first predetermined diameter value to generate a third predetermined diameter value, and a second tapered bore is ground in the outboard end of the workpiece while in its second location on the drive plate, and interrupted when the first gage finger indicates that said third predetermined diameter is reached at the first gage distance from the drive plate.

1 Claim, 4 Drawing Figures

GAGE CONTROLLED GRINDING METHOD

BACKGROUND OF INVENTION

In the grinding field, particularly for internal grinders for grinding bearing races, it is frequently encountered where a bearing race has a pair of oppositely disposed identical angle tapered bores, as in the cup of a double row tapered roller bearing. It is preferable that the bearing race have its tapered bores ground on a common setup, to insure concentricity with the support shoes, and squareness with the common drive plate of the machine. A single wheel of a wheel head is generally employed, which is movable in a radial direction of the workpiece to finish the bores. It is preferable that a constant dimension be held between identical gage diameters on the twin bores, to maintain the cone spacing in a final bearing assembly. The twin bores must therefore be ground in a precision manner, and would present no difficulty when turning the workpiece end-for-end and accomplishing the grind of each bore, except for the fact that the overall width of the workpiece may vary within given manufacturing tolerances from a standard gage master part. If a wider-than-standard workpiece were turned end-for-end and ground by a fixed grinding wheel movement, it is possible that deeper bores would be generated in opposite ends of the workpiece and the constant desired dimension would be decreased, thus allowing the cones of the final assembly to come closer together. It is therefore desirable practice to accomplish "gage grinding" of the bores; that is, wherein a gage finger is utilized to terminate the grind cycle at predetermined bore positions. One method that has been suggested is to use a single gage finger which may be applied internally to the first bore to be shaped and, thereafter, when the workpiece is turned end-for-end the gage finger would be axially advanced through the workpiece to recontact the then drive plate-facing bore to sense any shift of position which may be caused by the width tolerances of the workpiece. Thereafter, an iteration may be made to account for any location changes and the gage finger would be retracted out to the next to-be-ground bore to gage grind to a point insuring constancy of the gage dimension and subsequent spacing of the roller cones. One difficulty inherent in this scheme is that a complex gage head must be utilized with advancement means for shifting the gage finger back and forth axially within the workpiece. Additionally, location stops must be provided for the gage finger and thus inaccuracies may develop in the stopping points of the gage during its excursion through the workpiece.

Applicant has obviated the difficulties inherent in the prior art devices, by a unique gage grinding method utilizing a pair of gage fingers and selective sampling and comparing of previously ground diameters to known standards to accomplish a final grind of a tapered bore. One such grinder to which my invention may be adapted is defined in U.S. Pat. No. 3,157,007, which is an internal grinding machine having support shoes for radially supporting the workpiece and a drive plate for driving and axially supporting the workpiece while a grinding wheel is radially fed into the workpiece for a grinding operation. It is therefore the principle objective of this invention to maintain the standard spacing of two tapered bore gage diameters on a workpiece independent of workpiece length.

SUMMARY OF THE INVENTION

The invention is shown embodied in a grinding method employed on an internal grinding machine, wherein a workpiece has opposite end bores to be finished on the machine and the workpiece having first and second opposite end faces is carried on radial support shoes and a drive plate for endwise location. A first end face of the workpiece is located on the drive plate, and a first tapered bore at the second, outboard, end face of the workpiece is ground. The first bore is gaged with a gage finger at a predetermined gage distance from the drive plate during the grinding operation, and the grinding operation is interrupted when the first gage finger indicates a first predetermined diameter. Next, the workpiece is turned end-for-end and located with its second end face against the drive plate. The previously finished diameter of the first bore is sampled with a second gage finger located at predetermined gage distance from the second end face. The sampled diameter is compared with a second predetermined stored value, and the sampled diameter is subtracted from the second predetermined stored value to generate a difference value. The first predetermined diameter is added to the difference value to adjust the predetermined first diameter to a generated third predetermined diameter value. Thereafter, a second tapered bore is ground in the workpiece at the first end face while the second end face is located, and the second bore is gaged with the first finger gage at the first gage distance while the second bore is ground. Grinding of the second bore is interrupted when the first gage finger indicates that the third predetermined diameter has been reached at the first gage distance.

BRIEF DESCRIPTION OF THE DRAWINGS

FIG. 4 is a block diagram utilized in employing the inventive method.

DESCRIPTION OF THE PREFERRED EMBODIMENT

Figures 1, 2, 3:
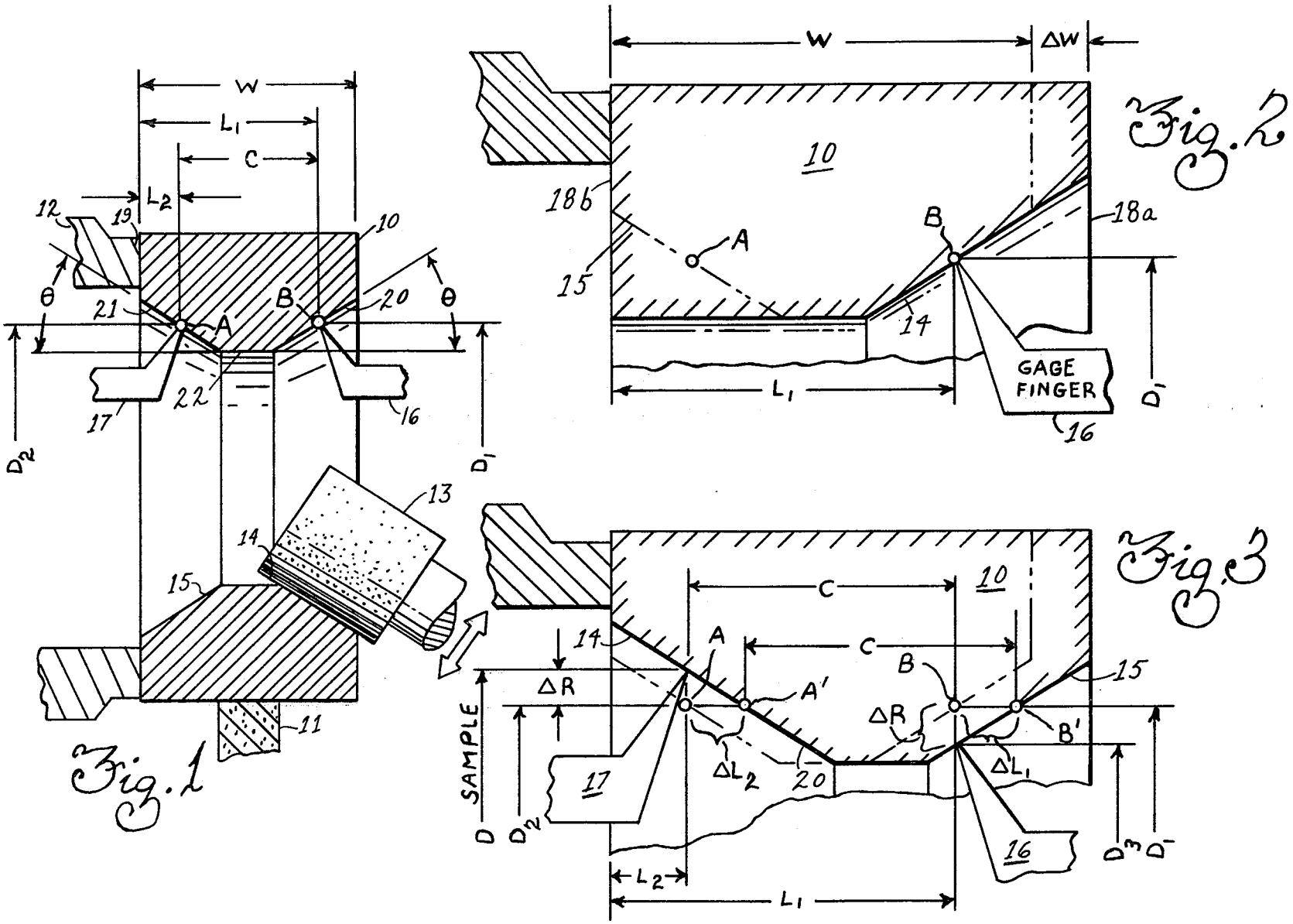
FIG. 1 is a section through the workpiece employing the inventive method.
FIG. 2 is an enlarged section through an increased width workpiece while grinding the first tapered bore.
FIG. 3 is an enlarged section through the workpiece of FIG. 2 turned end-for-end for grinding the second tapered bore.
Figure 2:
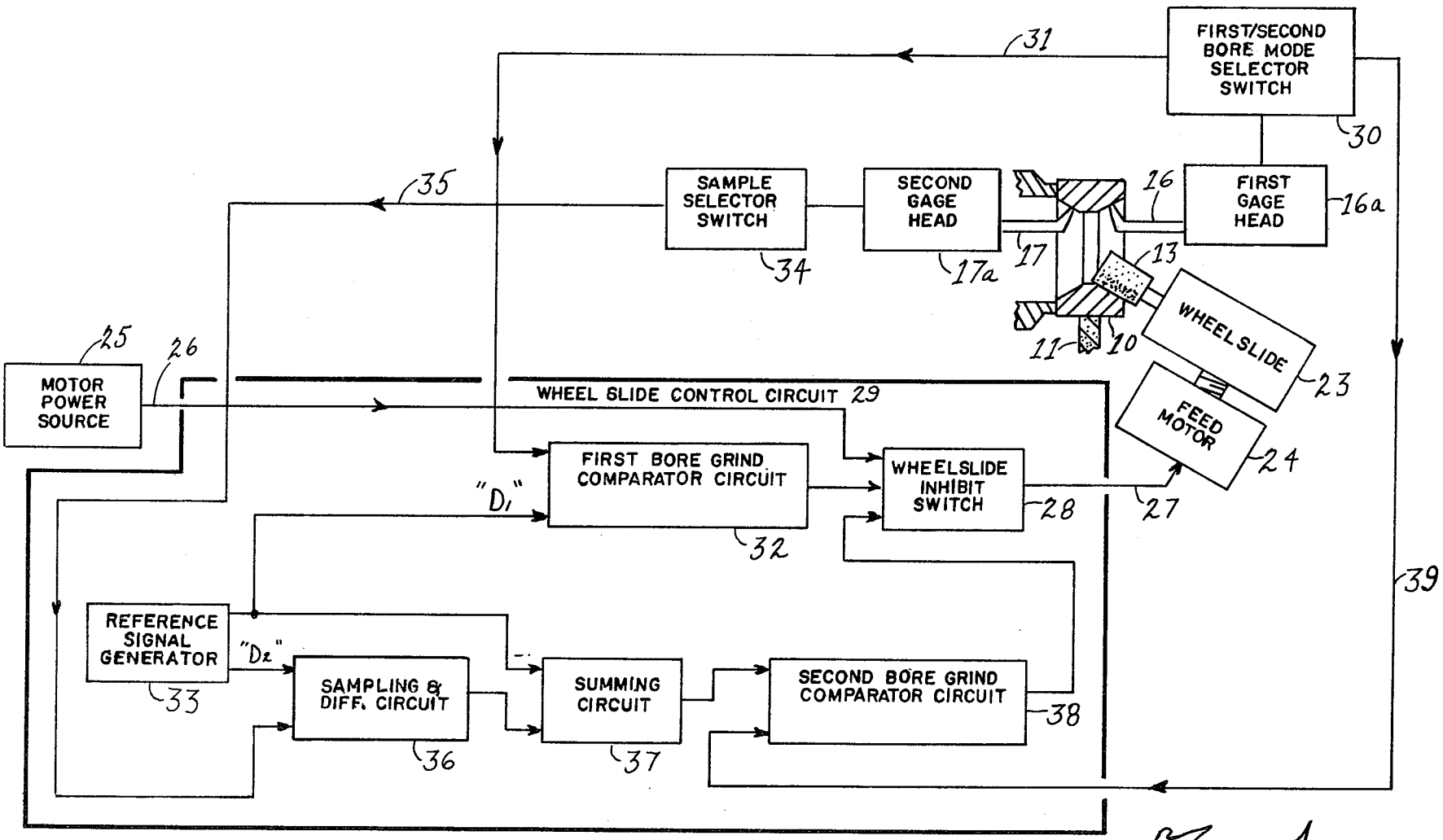

FIG. 1 depicts a standard workpiece or master part 10 known as a double row cup which is the outer race of a double row tapered roller bearing assembly. The master part 10 is shown radially supported on a shoe assembly 11 and endwise supported against a drive plate 12 in a manner conventional to internal grinding art. For convenience of reference, the same numbers are used on both the master part and the actual workpiece. A conventional grinding wheel 13 is employed in machining the oppositely disposed tapered bores 14,15 wherein the grinding wheel 13 is moveable radially in the direction of the double ended arrow. A pair of gage fingers 16,17 are employed to indicate and sense diameters during the grinding operation, wherein the first gage finger 16 is supported outside the outer end **18*a* of the workpiece 10 by a first gage head 16*a* (not shown) and a second gage finger 17 is supported through the drive plate 12 by a second gage head 17*a* (not shown), and the gage fingers 16,17 are movable in a radial direction relative to the workpiece 10. It may be noted that the second gage finger 17 may alternatively be supported from outside the outer end 18***a* of the workpiece 10. The first gage finger 16 is located at a fixed gage distance $L_1$ from the drive plate face 19, and the second gage finger 17 is located at a distance $L_2$ from the drive plate face 19, such that the distance between the gage fingers, "C" equal to $L_1$ minus $L_2$, represents a constant dimension between identical diameters $D_1$,$D_2$ on the tapered bores 14,15. The tapered bore faces 20,21 are angled at a slope $\theta$ to the central diameter 22, so that a radial shift on either bore 14,15 results in a corresponding axial shift in accordance with the slope. It is desirous to maintain the gage distance C between identical gage diameters, in order to maintain spacing of the roller cones or inner races, not shown, of a final bearing assembly. The first gage diameter $D_1$ corresponds to an identical second gage diameter $D_2$, and the respective intersection of the diameters $D_1$ and $D_2$ with their respective tapered bores may be appropriately labeled points A and B, for reference. If all parts were of constant width W, gage grinding of the first bore to the diameter $D_1$ at reference dimension $L_1$, would always result in an indication of diameter $D_2$ at $L_2$ when the part is turned end-for-end. However, due to manufacturing tolerances, it is frequently encountered that the overall width of the workpieces varies plus or minus from the standard width W, and it is preferable to utilize a gaging technique which takes the width variations into account in order to maintain the fixed gage dimension C.

FIG. 2 illustrates a grind operation performed on a workpiece 10 having a width variance of "plus $\Delta W$". To simplify explanation of the grind technique, the standard or master part 10 is superimposed and shown in phantom, and it may be assumed that the workpiece to be ground is shaped from solid stock, while in reality the tapered bores to be generated would be preformed in a turning operation and would include a certain amount of grinding stock which, likewise, is not shown for purposes of illustration. In the first step, the workpiece 10 is supported against the drive plate face 19 and the first tapered bore 14 is ground while the wheel is under the control of the radially moveable first gage finger 16. When the gage finger 16, located at distance $L_1$ from the drive plate face 19, is moved to such radial point as to indicate that predetermined diameter $D_1$ has been reached, the grind is interrupted and the grinding wheel withdrawn from the bore 14. Here it may be seen that when measured from the outer or second face 18*a* of the workpiece 10, the first tapered bore 14 is now deeper with respect to the face 18*a*, and it may be seen that if the workpiece 10 were turned end-for-end and the identical grind diameter formed on the opposite end 18*b*, the twin bores 14,15 would be closer to one another than is desired.

When the workpiece 10 is turned end-for-end, as shown in FIG. 3, and the second end 18*b* of the workpiece 10 supported by the drive plate face 19, it may be seen that the first finished bore 14 does not coincide with the phantom outline of the master part 10, but rather is deeper into the workpiece 10. The second gage finger 17 is therefore radially moved at dimension $L_2$ to sense the equivalent sample diameter corresponding to the dimension $L_2$. This sample diameter "D-sample" is therefore compared to the stored theoretical, or reference diameter $D_2$, and it is determined that a radial difference $\Delta R$ exists between the actual tapered bore 14 and the theoretical bore of the phantom outline. Because the tapered bore 14 has a linear surface 20 at angle $\theta$ (FIG. 1); that is, having a constant slope, it may be seen that an axial shift $\Delta L_2$ has occurred at diameter $D_2$ between the phantom face and the sampled tapered bore face 20. Because the slopes of the two tapered bores 14,15 are identical but opposite to one another, it may be seen that the phantom face at the right of the master part 10 should therefore be shifted axially through a dimension $\Delta L_1$ equal to $\Delta L_2$. In order to accomplish the shift $\Delta L_1$ and signal the same solely by the radial movement of the first gage finger 16, the finger 16 must therefore be radially moved to a point at $\Delta R$ from the theoretical or stored dimension $D_1$, i.e. at an adjusted diameter $D_3$, for accomplishing the grind of the second tapered bore 15. Therefore, when the grind of the second tapered bore 15 has commenced, the first gage finger 16 located at dimension $L_1$ is radially movable until the adjusted grind diameter $D_3$ is sensed, at which time the grind operation is interrupted and the grinding wheel 13 withdrawn from the tapered bore 15. From the foregoing technique, it may be therefore seen that the constant dimension C is held between equivalent diameters $D_1$,$D_2$ on the tapered bores 14,15, but is shifted from the theoretical points A and B, of the master part, to actual points A' and B' on the finished bores 14,15 of the workpiece 10.

In the block diagram shown in FIG. 4 the workpiece 10 is diagrammatically shown supported by a work support shoe 11 and the drive plate 12. A wheel slide 23 and corresponding grinding wheel 13 is shown slideably movable by an appropriate feed motor 24. The first and second gage fingers 16,17 are supported in first and second gage heads 16*a*,17*a* respectively. A motor power source 25 is connected in series by the lines 26 and 27 through the wheel slide inhibit switch 28 of wheelslide control circuit 29 to the feed motor 24, wherein the power may be interrupted to the feed motor 24 by appropriate control signals. A first/second bore mode selector switch 30 is employed at the first gage head 16 to signal the different grind operations. When the first bore mode is operable, the first bore is finished by the grinding wheel 13 until such point as the first gage head 16 indicates that the target grind diameter $D_1$ has been reached. A signal is therefore output from the first gage head 16*a* along a line 31 to a first bore grind comparator circuit 32 which compares the first bore diameter signal to a first reference signal from a reference signal generator 33. The first bore grind comparator circuit 32 outputs a signal, at an appropriate time when the diameter $D_1$ has been reached, to the wheelslide inhibit switch 28 which interrupts the signal along the line 27 to the feed motor 24, thus terminating the grind of the first bore. Thereafter, the wheelslide 23 may be retracted from the grind bore by conventional retraction mechanism not shown. When the first bore grind has been completed, the workpiece 10 is turned end-for-end on the drive plate 12, and the second bore mode is selected and detected by the first gage head 16. Similarly, at such time, a sample selector switch 34 is operable to cause the second gage head 17*a* to read the sample bore diameter on the previously finished bore and a signal is output on line 35 to a sampling and difference circuit 36 which also receives a second reference signal from the reference signal generator 33 corresponding to the stored diameter $D_2$. The sampling diameter is subtracted from the diameter $D_2$ in the sampling and difference circuit 36 to generate a difference value. The difference value from the sampling and difference circuit 36 is input to a summing circuit 37 together with a third reference signal corresponding to diameter $D_1$, wherein the summing circuit 37 causes the values of diameter $D_1$ and the difference value to be added together and the total dimension output as a signal $D_3$ from the summing circuit 37. A second bore grind comparator circuit 38 receives the output $D_3$ of the summing circuit 37 and the signal of line 39, which is actual diameter being read during the second bore grind by the first gage head 16*a*. The second bore grind comparator circuit 38 therefore compares the desired signal $D_3$ to the actual signal of line 39 being read by the first gage head 16*a* and, at a predetermined time of coincidence, a signal is output to the wheel slide inhibit switch 28 to interrupt power to the wheel slide feed motor 24 and the second grind is stopped. Thereafter, the grinding wheel 13 is retracted from the second finished tapered bore in a conventional manner.

Here it may be noted that the first/second bore mode selector switch 30 and sample selector switch 34 are capable of automatic operation and sequence under the control of other machine circuitry not shown. Further, it may be noted that the second gage finger, while shown at dimension $L_2$ corresponding to diameter $D_2$ equal to diameter $D_1$ is shown at such position merely to assist the reader, but it may be appreciated that a different axial location for $L_2$ may be used and a $D_2$ value different from diameter $D_1$ may be stored in the sampling and difference circuit, since the slopes of the twin bores 14,15 are identical and a radial increment $\Delta R$ is constant along the face 20 of a sampled bore of FIG. 3 when compared to the phantom line of the master part 10.

It is therefore not intended to limit the invention to the specific embodiment shown, but rather the invention extends to all such designs and modifications as come within the scope of the appended claims.

What is claimed is:

1. A method for grinding oppositely disposed tapered end bores in a workpiece, comprising the following steps:

(a) choosing a reference bore diameter and corresponding reference distance from the end face of a theoretical workpiece master;

(b) locating a first end face of said workpiece on a driveplate;

(c) grinding a first tapered bore in said workpiece at the second opposite end face of said workpiece while located on said drive plate;

(d) gaging said first bore with a first gage finger at a first predetermined gage distance from said driveplate corresponding to said reference distance while grinding said first bore;

(e) interrupting said first bore grinding when said first gage finger indicates a first predetermined diameter corresponding to said reference bore diameter at said first gage distance;

(f) turning said workpiece end-for-end and locating said second end face on a drive plate;

(g) sampling the diameter of said first bore with a second gage finger at a predetermined second gage distance corresponding to said reference distance from said second end face while located;

(h) comparing said sampling diameter with a second predetermined stored diameter value corresponding to said reference bore diameter;

(i) subtracting said sampling diameter from said second predetermined stored diameter to generate a difference value;

(j) adjusting the value of said first predetermined diameter by adding said difference value to said first predetermined diameter value to generate a third predetermined diameter value;

(k) grinding a second tapered bore in said workpiece at said first end face while said second face is located;

(l) gaging said second bore with said first gage finger at said first gage distance while grinding said second bore;

(m) interrupting said second bore grinding when said first gage finger indicates said third predetermined diameter at said first gage distance.

* * * * *